US007147505B2

(12) United States Patent
Li et al.

(10) Patent No.: US 7,147,505 B2
(45) Date of Patent: Dec. 12, 2006

(54) CONNECTOR ASSEMBLY WITH STRAIN RELIEF MEMBER

(75) Inventors: Li Li, Kunshan (CN); Yu-Hua Mao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/377,829

(22) Filed: Mar. 15, 2006

(65) Prior Publication Data

US 2006/0211293 A1 Sep. 21, 2006

(30) Foreign Application Priority Data

Mar. 15, 2005 (CN) ..... 2005 2 0069886

(51) Int. Cl.
*H01R 13/58* (2006.01)

(52) U.S. Cl. ..... 439/455; 439/453

(58) Field of Classification Search ..... 439/455, 439/477, 453, 458, 465, 470, 471
See application file for complete search history.

(56) References Cited

U.S. PATENT DOCUMENTS 4,447,100 A 5/1984 Dyce et al.
4,838,810 A * 6/1989 Yoshimura et al. ..... 439/358
5,195,909 A * 3/1993 Huss et al. ..... 439/465
5,899,770 A * 5/1999 Ezawa ..... 439/418
6,062,895 A 5/2000 Lin et al.
6,068,506 A * 5/2000 Shen ..... 439/447
6,416,351 B1 7/2002 Ho

FOREIGN PATENT DOCUMENTS

CN 2469661 Y 1/2002

* cited by examiner

*Primary Examiner*—Tho D. Ta
*Assistant Examiner*—Vanessa Girardi
(74) *Attorney, Agent, or Firm*—Wei Te Chung

(57) ABSTRACT a connector assembly comprises an electrical connector (1); a cable assembly comprising a cable (2) having a connecting portion (22) electrically connecting with the electrical connector and a strain relief member (5) circumferentially fixed on the cable and located behind the connecting portion and a single-piece insulated member (4) encasing most portion of the connector assembly. The cable passes through a cable outlet (43) formed rear wall (42) of the single-piece insulated member to extend out. The strain relief member has a block portion (52) blocked against inside surface of the rear wall and an oblate boot portion (51) extending rearward from the block portion to just pass through the cable outlet. The oblate boot portion has a projecting portion (511) cooperating with the block portion to confine the insulated coating to move a front-to-rear direction.

12 Claims, 6 Drawing Sheets

CONNECTOR ASSEMBLY WITH STRAIN RELIEF MEMBER

BACKGROUND OF THE INVENTION

1. Field of the Invention

The present invention relates to a connector assembly, and more particularly to a connector assembly for connecting with a cable.

2. Description of Related Art

Electrical connectors are widely used for connecting electrical elements. In some application, the electrical connectors generally are connected with a cable or more for meeting the convenience operation or long-distance connecting requirements. As the cables always extend out of corresponding cable outlets located rear ends of the electrical connectors, it is easily that the cables are pulled by unexpectable excessive external force to break off the electrical connectors during transportation or using process. For solving the problem, the connector manufactures further design an auxiliary member which can effectively prevent the cables breaking off the electrical connectors. At present, there are four ways widely used to design the auxiliary member by the connector manufactures. Firstly, tie a knot in the cable inside the cable outlet. Secondly, use a holding wire plate to position the cable inside the cable outlet, and then use a plurality of blocks to fix the holding wire plate onto the electrical connector. Thirdly, arrange the cable extending along a crooked direction inside the cable outlet, a similar connector having this feature disclosed by China Patent Issue Number 2469661. Lastly, define a plurality of annular slots on the cable adjacent the cable outlet, and then assemble two-separated insulated coating onto the electrical connector so as to make rear ends of the separated insulated coating just being received in the annular slots, similar connectors disclosed in U.S. Pat. Nos. 4,447,100, 6,062,895 and 6,062,895.

However, with the developing tendency of lower product cost and higher performance, none of the preceding ways can greatly satisfy the connector manufactures.

SUMMARY OF THE INVENTION

An object of the present invention is to provide a connector assembly which has a stable performance.

Another object of the present invention is to provide a connector assembly which can simplify assembling process to decrease produce cost.

In order to achieve above-mentioned objectives, a connector assembly is provided and comprises an electrical connector having a mating portion for mating with a complementary element; a cable assembly comprising a cable having a connecting portion electrically connecting with the electrical connector and a strain relief member circumferentially fixed on the cable and located behind the connecting portion and a single-piece insulated member encasing most portion of the connector assembly therein except where the cable extends out of a cable outlet from the rear wall of the single-piece insulated coating. The strain relief member has a block portion blocked against inside surface of the rear wall of the single-piece insulated coating and a oblate boot portion extending rearward from block portion which interferingly fits to just pass through the cable outlet. The oblate boot portion has a projecting front-to-back movement of the insulated coating.

Other objectives, advantages and novel features of the present invention will become more apparent from the following detailed description of the present embodiment when taken in conjunction with the accompanying drawings.

DETAILED DESCRIPTION OF THE INVENTION

Figure 1:
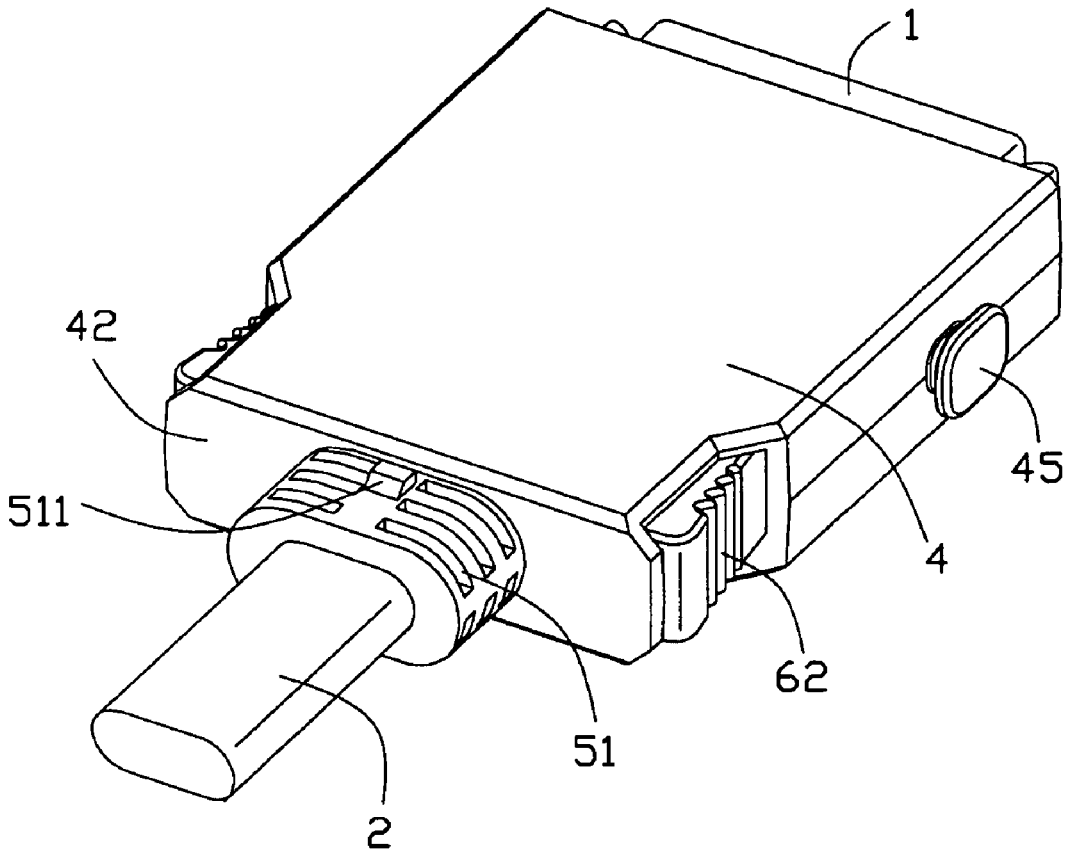
FIG. 1 is a completely assembled perspective view of a connector assembly in accordance with the present invention.

Reference will now be made to the drawing figures to describe the preferred embodiment of the present invention in detail.

Figure 2:
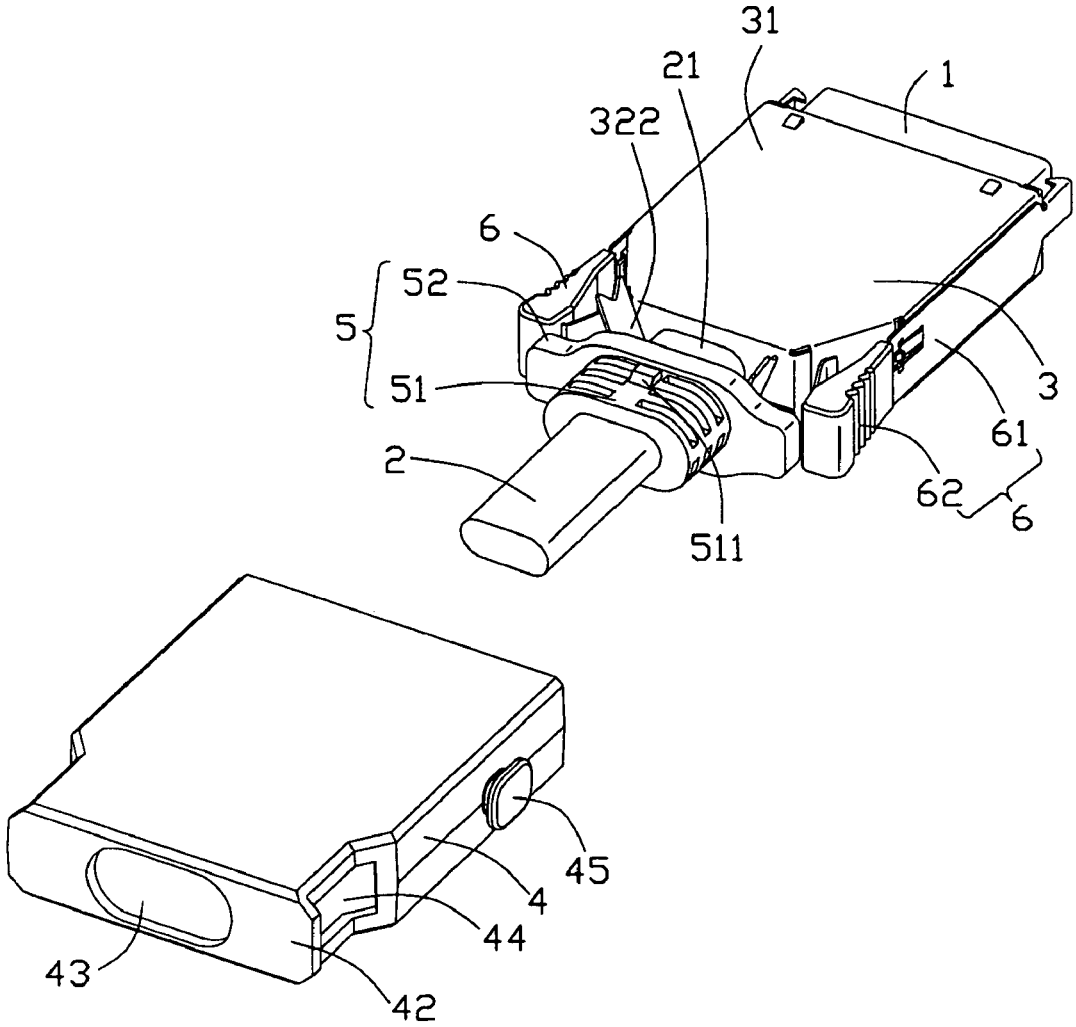
FIG. 2 is a semi-assembled perspective view of the connector assembly shown in FIG. 1 without a single-piece insulated coating assembled thereon.
Figure 3:
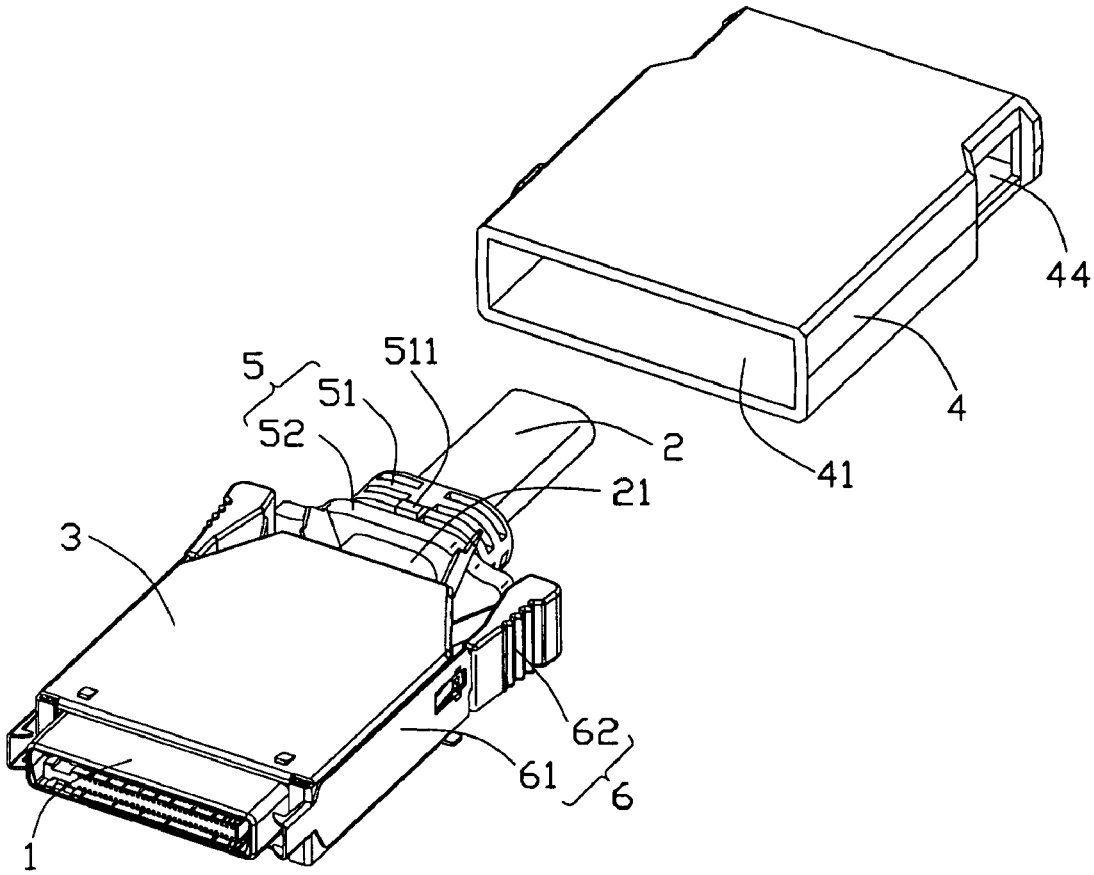
FIG. 3 is similar to FIG. 2, but taken from a front view.

Referring to FIGS. 1 to 3, a connector assembly in accordance with the present invention is provided. The connector assembly comprises an electrical connector 1 having a mating portion for mating with a complementary electronic element, a cable assembly electrically connecting with the electrical connector 1, a pair of metal shells 3 protecting the connector assembly from electro-magnetic interference and a single-piece insulated coating 4 encasing most portion of the connector assembly therein. The cable assembly comprises a cable 2 and a strain relief member 5 circumferentially overmolded on a front end of the cable 2 to finally permanently be fixed thereon. In the preferred embodiment, where the mating portion of the electrical connector 1 located is regarded as a front end of the connector assembly, and where the cable located is regarded as a rear end of the connector assembly.

Figure 4:
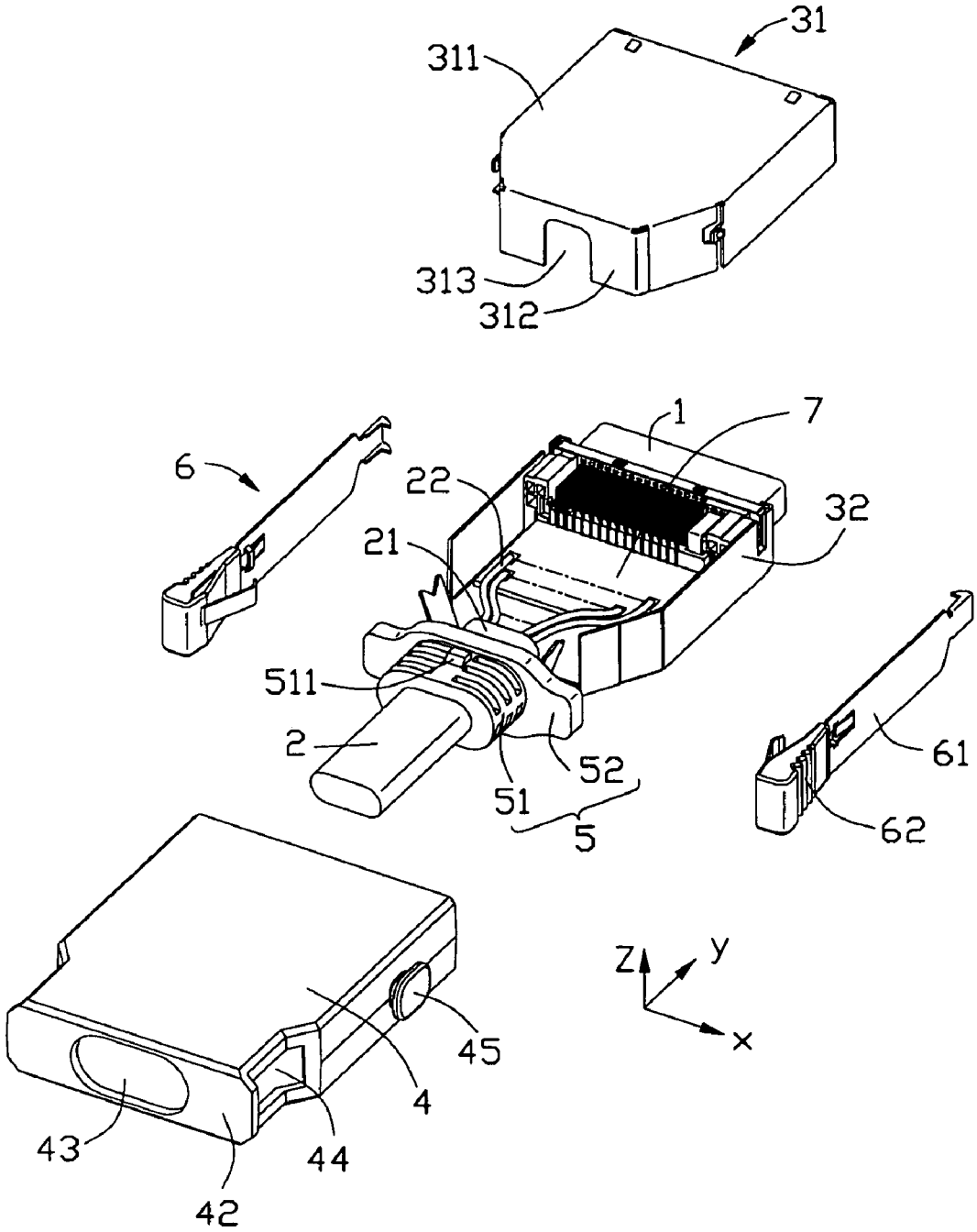
FIG. 4 is similar to FIG. 2 without a pair of latching member and an upper metal shell assembled on the connector assembly.

Referring to FIGS. 3 and 4, the connector assembly further comprises a printed circuit board 7. The electrical connector 1 has a plurality of electrical contacts with right angle tails mounted on the printed circuit board 7 and electrical connecting with the cable 2 by right of the printed circuit board 7.

The cable 2 comprises a connecting portion 22 at the front end thereof, and the connecting portion 22 is made by a plurality of core wires to electrically and mechanically being mounted to the printed circuit board 7. Said strain relief member 5 is located behind the connecting portion 22, and there remain a cable segment marked by character number 21 between the strain relief member 5 and the connecting portion 22.

Figure 5:
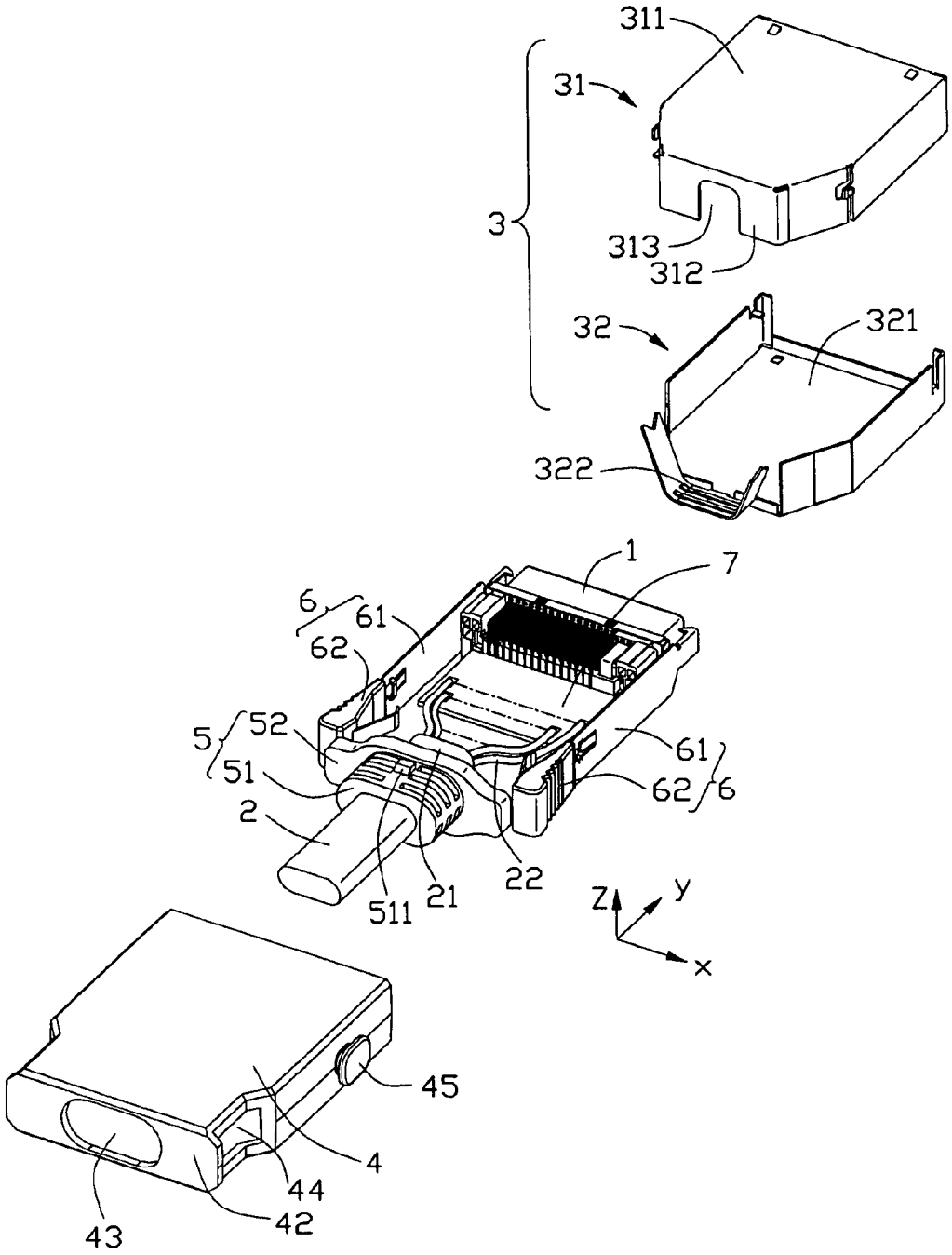
FIG. 5 is similar to FIG. 2 without the upper metal shell and a lower metal shell assembled on the connector assembly.

Referring to FIGS. 4 and 5, the strain relief member 5 is made of elastic plastic and comprises a block portion 52 and an oblate boot portion 51 integrally extending rearward from the block portion 51. The boot portion 51 has a major axis in a transverse direction X and a minor axis in a vertical direction Z perpendicular to the transverse direction X. The block portion 52 has a larger dimension in both the transverse direction X and the vertical direction Z than the boot portion 51.

The pair of metal shells 3 are defined as an upper metal shell 31 and a lower metal shell 32. The upper metal shell 31 comprises a six-polygon-shaped flat top wall 311 and a plurality of down-standing walls extending from edges of the top wall 311. Said standing walls comprise a pair of sidewalls located opposite (not labeled) to each other, a pair of connecting walls (not labeled) extending rearward from corresponding rear ends of the sidewalls and angled with the corresponding sidewalls from a top view and a transverse wall 312 connecting the pair of connecting walls together. The transverse wall 312 has a generally rectangular shaped gap 313 recessed upward from middle portion of bottom edge thereof. The lower metal shell 32 has a generally similar shape as the upper metal shell 31 and comprises a flat bottom wall 321 and a plurality of upstanding walls extending upward from the bottom wall 321. The lower metal shell 32 further has a support portion 322 extending rearward from middle portion of the bottom wall 321. The support portion 322 comprises a plane portion arranged in coplanar with the bottom wall 321 and having a plurality ridges thereon and a pair of wing portion symmetrical and splayingly extending from corresponding lateral ends of the plane portion toward the upper metal shell 31.

Figure 6:
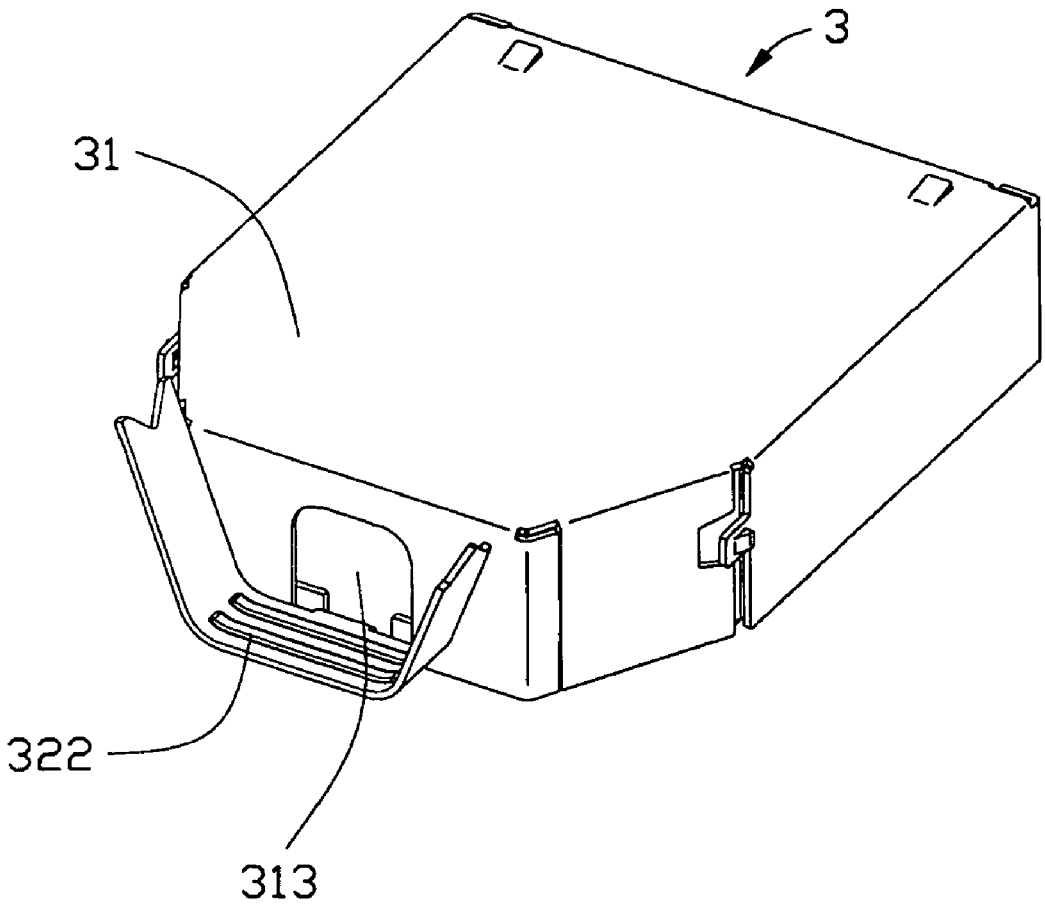
FIG. 6 is perspective view of the upper and lower metal shell, intending to show positioning relationship between the upper and lower metal shells.

Referring to FIGS. 2, 4 and 6, after the pair of metal shells 3 mating together, the opposite disposed sidewalls of the upper metal shell 31 respectively cover side walls of the lower metal shell 32 so as to form a box room for encasing the electrical connector 1, the printed circuit board 7 and the connecting portion 22 therein. Meanwhile, the gap 313 cooperates with the lower metal shell 32 to serve as a passageway for core wires of the cable 2 passing through. The support portion 322 is located behind the outlet of the metal shells and just supports the cable segment 21 thereon.

Referring again to FIGS. 4 and 5, each of sidewalls of the lower metal shell 32 has a latching portion (not labeled) extending into the box room for latching the lower metal 32 onto an insulated housing of the electrical connector 1 at front portion thereof so that the metal shells 3 is stably positioned relatively to the electrical connector 1. Moreover, the wing portions of the support portion 322 just abut against a front surface of the block portion 52 of the strain relief member 5 so as to not only make the metal shells 3 more stable in the connector assembly but also make the connector assembly having a compact configuration.

The connector assembly further comprises a pair of latching member 6 each of which having a latching arm 61 and an operating portion 62 extending rearward from the latching arm 61. The latching portion 61 has a latch arranged at its distal end and toward the electrical connector 1 for locking with a complementary connector (not shown) and a fulcrum portion (not labeled) mounted onto the metal shells 3. The operating portion 62 has a resilient tab extending inward from inside surface thereof. The operating portion 62 is pressed inward to make the resilient tab in elastic distortion state during initially mating of the connector assembly, then the latching arm 61 moves around the fulcrum portion to cause the latch moving outward. After the mating portion of the electrical connector 1 completely inserting the complementary connector, the operating portion 62 is released to move outward to original position by the elasticity force produced by the resilient tab, meanwhile, the latch moves inward to latch onto corresponding portions of the complementary connector so as to achieve a stable engagement between the connector assembly and the complement connector.

Referring again to FIGS. 1 to 4, the single-piece insulated coating 4 has a tank-shaped configuration and comprises a receiving space 41 for containing most portion of the connector assembly therein and a cable outlet 43 formed at middle portion of a rear wall 42 thereof so as to let the cable 2 passing through. The cable outlet 43 is configured to be generally similar shape and size as the boot portion 51 for making the boot portion 51 just passing through. The single-piece insulated coating 4 has two opposite arranged sidewalls connected by the rear wall 42. Each sidewall has a shoulder portion recessed inward from rear portion adjacent with the rear wall 42 and defining an opening 44 communication with the receiving space 41. After the single-piece insulated coating 4 completely mounted on the connector assembly, the operating portions 62 of the latching members 6 are respectively pushed through the corresponding openings 44 by the resilient tabs and finally located beside the corresponding shoulder portions for facilitating to be operated. At least one of the sidewalls of the insulated coating 4 further has a handhold portion 45 extending outward from a front portion thereof for facilitating operators in assembling process.

As described above, the strain relief member 5 is circumferentially fixed on the cable 2. The strain relief member 5 further comprises a plurality of slots (not labeled) regular arranged on the boot portion 51 to bear excessive external force applied on the cable 2 and a projecting portion 511 projecting outward from middle portions of the periphery of the boot portion 51 along the vertical direction Z. The projecting portion 511 also can be arranged to circumferentially extend from the entire periphery of the boot portion 51, as long as the remain space between the projecting portion 511 and the block portion 52 in a front-to-rear direction Y is enough to receive the rear wall 42 of the insulated coating 4 thereon. The projecting portion 511 has enough elasticity to produce distortion when bearing external force, and also resile to its original structure after external force being released. The projecting portion 511 defines an inclining surface at rear end for facilitating the insulated coating 4 gradually climbing over the projecting portion 511. In order to prevent the insulated coating 4 easily backing off the connector assembly, the front surface of the projecting portion 511 is designed to a substantially upright surface.

Generally, the insulated coating 4 is assembled in the front-to-rear direction Y after the cable 2, the printed circuit board 7, the metal shells 3 and the latching member 6 all completely being assembled together. The rear wall 42 urges the projecting portion 511 to elastically distort to climb over the projecting portion 511, and the block portion 52 of the strain relief member 5 blocks the insulated coating 4 to be assembled in an accurate position avoiding excessive assembly. The rear wall 42 is finally confined by the front surface of the projection portion 511 and the block portion 51 and the other parts are meanwhile encased in the receiving space 41 except the mating portion and the latches used for mating with the complementary element.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

an electrical connector;

a cable assembly comprising a cable having a connecting portion at front end thereof for electrically connecting with the electrical connector and a strain relief member circumferentially fixed onto the cable to be located behind the connecting portion and the strain relief member having a block portion and a boot portion extending rearward from the block portion; and a single-piece coating mounted to the cable assembly in a front-to-rear direction and a cable outlet formed at a rear wall thereof for the cable assembly to pass through;

wherein the boot portion has a projecting portion arranged with a space from the block portion, the rear wall of the single-piece coating is pressed to climb over the projecting portion to be received in the space so that the single-piece coating is confined in the front-to-rear direction.

2. The connector assembly as claimed in claim 1, wherein the projecting portion defines an inclining surface at rear end thereof for facilitating the single-piece coating gradually climbing over.

3. The connector assembly as claimed in claim 2, wherein the projecting portion defines a substantially upright front surface to avoid the single-piece coating backing off the cable assembly.

4. The connector assembly as claimed in claim 1, further comprising a printed circuit board on which the electrical connector is mounted to electrically connect with the connecting portion of the cable.

5. The connector assembly as claimed in claim 1, further comprising an upper and a lower metal shells respectively assembled in a vertical direction perpendicular to the front-to-rear direction and encased by the single-piece coating therein.

6. The connector assembly as claimed in claim 5, wherein the lower metal shell has a support portion integrally extending rearward from flat bottom wall thereof, and the cable assembly has a cable segment between the connecting portion and block portion of the cable supported by the support portion.

7. The connector assembly as claimed in claim 5, further comprising a pair of latching members respectively mounted on opposite lateral sides of the metal shells.

8. The connector assembly as claimed in claim 7, wherein each latching member has an operation portion extending out of the single-piece coating for controlling the moving states of the latch.

9. The connector assembly as claimed in claim 1, wherein the single-piece coating is integrally made of insulated plastic.

10. The connector assembly as claimed in claim 1, wherein the boot portion has a generally oblate shape and defines a plurality of slots thereon.

11. The connector assembly as claimed in claim 1, wherein the strain relief member is permanently overmolded onto the cable.

12. A connector assembly comprising:

an electrical connector;

a cable assembly comprising a cable having a connecting portion at a front end thereof for electrically connecting with the electrical connector and a strain relief member circumferentially fixed onto the cable to be located behind the connecting portion and the strain relief member having a block portion and a boot portion extending rearward from the block portion;

a single-piece coating mounted to the cable assembly in a front-to-rear direction and a cable outlet formed at a rear wall thereof and being dimension large enough for allowing a rear portion of cable assemble to extend therethrough while also small enough for preventing the blocking portion pass therethrough; and a space being defined between the block portion and the boot portion in said front-to-rear direction; wherein a portion of said boot portion of which a radial dimension is large than that of the cable outlet while being inwardly and radially retractable so as to allow said ca cable assembled to be assembled to the coating in said front-to-rear direction and secured to the coating once said portion is resumed from a compression status to a relaxed status.

* * * * *